United States Patent [19]

Turner et al.

[11] Patent Number: 4,713,833

[45] Date of Patent: Dec. 15, 1987

[54] X-RAY SOURCE APPARATUS

[75] Inventors: David W. Turner; Andrew J. Dixon; Karl A. Gehring, all of Oxford; Michael Keenlyside, Oxfordshire, all of United Kingdom

[73] Assignee: Kevex Corporation, Foster City, Calif.

[21] Appl. No.: 797,197

[22] PCT Filed: Jun. 16, 1983

[86] PCT No.: PCT/GB83/00157

§ 371 Date: Feb. 17, 1984

§ 102(e) Date: Feb. 17, 1984

[87] PCT Pub. No.: WO84/00079

PCT Pub. Date: Jan. 5, 1984

Related U.S. Application Data

[63] Continuation of Ser. No. 588,875, Feb. 17, 1984.

[30] Foreign Application Priority Data

Jun. 17, 1982 [GB] United Kingdom ..... 8217609

[51] Int. Cl.[4] ..... G21G 4/00; H01J 35/00; H01J 35/30

[52] U.S. Cl. ..... 378/119; 378/137; 378/138

[58] Field of Search ..... 378/136–138, 378/119; 250/396 R, 396 ML, 398, 493; 313/424

[56] References Cited

U.S. PATENT DOCUMENTS

| | | | |
|---|---|---|---|
| 1,211,091 | 1/1917 | Coolidge | 378/138 |
| 1,911,976 | 5/1933 | Strigel | 313/424 |
| 2,019,600 | 11/1935 | Ehrke | 378/138 |
| 2,464,419 | 3/1949 | Smith et al. | 250/396 |
| 2,533,859 | 12/1950 | Wideroe | 378/138 |
| 2,727,171 | 12/1955 | Gier | 313/424 |
| 2,866,113 | 12/1958 | Cosslett | 378/138 |
| 2,871,402 | 1/1959 | Lempert | 313/424 |
| 3,374,355 | 3/1968 | Parratt et al. | 378/138 |
| 3,567,983 | 3/1971 | de Vries | 378/138 |
| 4,104,526 | 8/1978 | Albert . | |
| 4,122,346 | 10/1978 | Enge . | |
| 4,309,637 | 1/1982 | Fetter . | |
| 4,408,338 | 10/1983 | Grobman | 378/119 |

FOREIGN PATENT DOCUMENTS

| | | | |
|---|---|---|---|
| 0030453 | 6/1981 | European Pat. Off. | 378/144 |
| 2812644 | 10/1978 | Fed. Rep. of Germany . | |
| 2384415 | 10/1978 | France . | |
| 8202624 | 8/1982 | World Int. Prop. O. | 250/396 |
| 734425 | 8/1955 | United Kingdom | 378/71 |
| 1084015 | 9/1967 | United Kingdom . | |
| 1183061 | 3/1970 | United Kingdom . | |
| 1435526 | 5/1976 | United Kingdom . | |
| 2018507 | 10/1979 | United Kingdom . | |
| 1602011 | 11/1981 | United Kingdom . | |

OTHER PUBLICATIONS

*Handbook of X-Ray and Ultraviolet Photo-Electron Spectroscopy,* edited by D. B. Briggs, Heyden 1978, pp. 81–84.

Beamson et al, "The Collimating and Magnifying Properties of a Superconducting Field Photoelectron Spectrometer", J. Phys. E: Sci. Instrum., vol. 13, 1980, pp. 64–66.

*Primary Examiner*—Carolyn E. Fields
*Assistant Examiner*—Joseph A. Hynds
*Attorney, Agent, or Firm*—Beveridge, DeGrandi & Weilacher

[57] ABSTRACT

An X-ray source apparatus contains an X-ray target which emits X-ray when bombarded with electrons from an electron source. A strong magnetic field, e.g. from a superconducting solenoid, having curved lines of magnetic flux interlinks the target and electron source. The magnetic field has sufficient strength over the entire electron path of travel to constrain the electrons emitted from the source with components at angles to the magnetic field to execute helical paths about the field lines to the target. An aperture means is positioned to block the straight line paths between the source and the target but permits the passage of substantially all electrons traveling along the lines of flux.

8 Claims, 4 Drawing Figures

FIG. 2.

X-RAY SOURCE APPARATUS

This application is a continuation, of application Ser. No. 588,875, filed Feb. 17, 1984.

The present invention is concerned with X-ray source apparatus. A typical form of X-ray source available hitherto has an anode or anodes which are normally water cooled and at ground potential and which are bombarded with electrons from an electron gun having a filament biased at a high negative potential with respect to the anode. Typically the electrons travel in straight lines from the electron gun filament to the anode or anodes.

Commonly, X-rays generated by the electron bombardment of the target are emitted from the source through a thin metal window (typically 0.004" thick aluminum). The target and electron source are, of course, in an evacuated chamber.

This kind of X-ray source has disadvantages in certain applications. Firstly, because of the straight line (line of sight) arrangement of the electron gun and target, material evaporated from the filament can contaminate the anode which attenuates the flux of X-rays at the characteristic wavelength of the target and introduces impurity lines into the X-ray spectrum. Secondly, high energy elastically scattered electrons may be emitted from the surface of the target anode and strike the aluminum window. Such elastically scattered electrons may have energies of the order of 15 keV. These can result in melting of the window during high power operations and also the production of X-rays at wavelengths characteristic of aluminum. Furthermore, secondary electrons may be ejected from the aluminum of the window into the region to be irradiated by the X-rays.

The above disadvantages are particularly important where the X-ray source is used to irradiate a sample for analytical purposes, particularly in photo-electron spectrometry. In such instruments, a specimen to be analysed is irradiated with characteristic X-rays from the X-ray source and any irradiation with stray electrons such as emitted from the aluminum window can degrade the sample.

An existing form of X-ray source which avoids a number of the above disadvantages uses a target anode held at a positive potential with the electron source filament maintained at or close to ground potential. The filament is also located out of the line of sight to the target anode and focusing shields are provided to produce an electric field which focuses electrons emitted by the filament onto the target anode as desired. With this arrangement material evaporated from the filament does not contaminate the target anode and the high positive voltage of the target anode draws back elastically scattered electrons and prevents them from striking the aluminum window.

With this positive anode X-ray source, however, it is essential to ensure good electrical screening of the anode when the source is being used to irradiate a specimen for example in an electron spectrometer. It is then important to ensure that the specimen is isolated from the electric field of the source so that electrons emitted by the specimen are not deviated. Because of the need for electrical shields, there is a limit to how close the target anode can be placed to a specimen to be irradiated.

Also, in a practical source, a defined area of the anode produces X-rays able to illuminate the specimen. The useful X-ray intensity therefore depends on the electron current density at the anode. In a conventional source using electric field focusing, the current density is limited amongst other things by space charge spreading of the electron beam.

An example of positive anode X-ray source is described in Handbook of X-ray and Ultra-Violet Photo-Electron Spectroscopy, edited by D. B. Briggs Heyden, published 1978 (pages 81–84).

According to the present invention, X-ray source apparatus comprises, in an evacuated chamber, an X-ray target of a selected material which emits X-rays when bombarded with electrons of at least a predetermined energy, a source of electrons and means for accelerating electrons from the source to at least said predetermined energy, means for generating a magnetic field with lines of flux interlinking said target and said electron source and having sufficient strength that electrons of the energies of those accelerated from the source with components at angles to the magnetic field are constrained by the field to execute a helical motion along the direction of the magnetic field, with the radius of the helix being small compared to the dimensions of the apparatus.

By employing a strong magnetic field in this way to "focus" or constrain electrons emitted by the source and accelerated towards the target to spiral along the lines of flux to the target, the spacing between the target and the source may be considerably increased without loss of electron flux onto the target. Very importantly, the fact that the target is in the strong magnetic field ensures also that any elastically scattered electrons from the target are similarly constrained to move back along the flux lines. Thus by suitably orientating the target relative to the flux lines (and the general direction of bombarding electron flux) X-rays can be emitted from the target to irradiate a nearby sample whilst the sample is positioned clear of the path of electrons bombarding the target and of any scattered electrons leaving the target. Thus, in the absence of any window separating the X-ray target and the specimen to be irradiated, irradiation of the specimen with elastically scattered electrons from the target is avoided. If a metal window is used between specimen and target, then the window can be positioned also so as not to be bombarded by scattered electrons.

The magnetic field also limits expansion of the electron beam by space charge spreading and allows a higher current density at the X-ray anode.

Conveniently, said means for generating a magnetic field is arranged such that the lines of flux interlinking said target and said electron source are curved and the apparatus includes aperture means blocking straight line paths between the source and target but permitting passage of electrons from the source along the flux lines to the target. It is relatively straightforward to arrange for the lines of flux interlinking target and source to be curved as envisaged in the above. This can be done by employing an axially symmetric magnetic field and locating the target slightly off axis in a region of strong field and locating the electron source in a region of relatively weaker field and appropriately further off axis such that the flux lines interlink target and source. By then employing the aperture means to restrict line of sight between target and source and permit only passage of electrons travelling along the flux lines, contamination of the X-ray target with material evaporated from the filament is avoided.

The target may be at earth potential and the means for accelerating may then comprise an earthed grid or iris along the lines of flux interlinking said source and said target and means for producing an electron accelerating electric potential gradient between the source and the grid or iris. It will be appreciated that with the arrangement of the present invention, contamination of the specimen with elastically scattered electrons is avoided even when using an X-ray target at earth potential. There is thus no need for the positive target anode arrangement employed hitherto. Thus, the usual electrical shielding for such positive anode arrangements can be dispensed with thereby permitting the X-ray target to be positioned much closer to the specimen with attendent increases in X-ray flux onto the specimen.

In one arrangement the electron source is a wire filament arranged to extend in a line at an acute angle to the lines of magnetic flux at the source and a DC voltage source to heat the filament. It will be appreciated that the filament is located in a region of relatively high mangetic field (though possibly weaker than the field of the target). Thus the DC current flowing in the filament will cause Lorenz forces to be exerted on the filament wire. By arranging th filament at an acute angle to the lines of flux the magnitude of Lorenz forces on the wire filament can be reduced. However, if the filament is too close to being parallel to the lines of flux, then thermal electrons are emitted from the filament with negligible velocity along the lines of flux and are prevented by the magnetic field from escaping the region of the filament. A compromise between these conflicting requirements is reached with typical filament angles of between 5° and 30° to the magnetic field.

In an alternative arrangement, the electron source is a wire filament arranged to extend in a circle in a plane perpendicular to the lines of flux at the source and a DC voltage source connected to heat the filament with a DC current directed about the filament such that Lorenz forces on the filament are directed radially outwards. With this arrangement, the Lorenz forces should not produce undesirable deviation of the wire filament provided the wire has sufficient strength in tension to withstand the forces when heated.

The present invention further envisages a photoelectron spectroscope or microscope having means for generating a magnetic field in the region of the specimen and X-ray source apparatus as claimed in any preceding claim having said target located adjacent the specimen in the magnetic field to irradiate the specimen.

Examples of the present invention will now be described with reference to the accompanying drawings in which.

Figure 1:
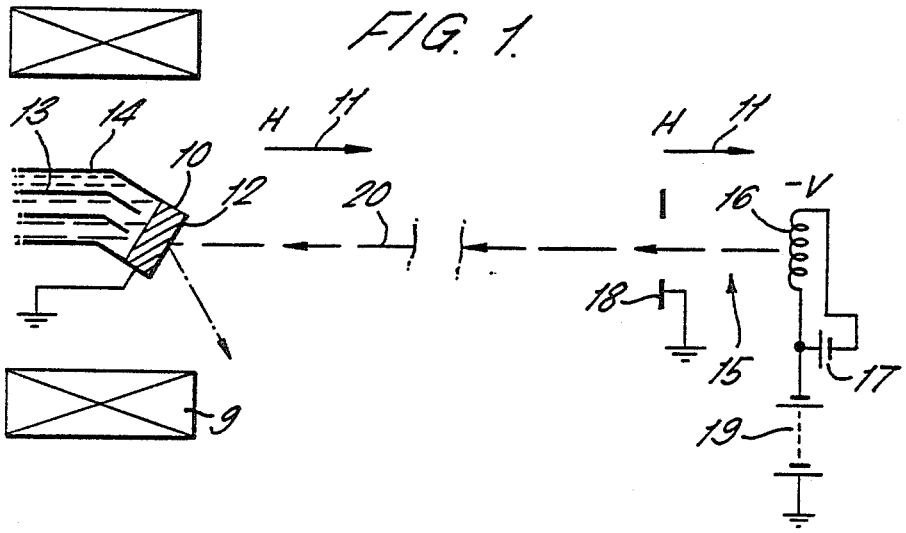
FIG. 1 is a schematic illustration of an example of X-ray source embodying the present invention.

Referring to FIG. 1, an X-ray target 10 is illustrated located in a region of magnetic field H, produced by a super conducting solenoid 9, the direction of the field and of the lines of flux being indicated by an arrow 11. The target 10 comprises a block of metal, typically magnesium, having a face 12 exposed to be bombarded by energetic electrons. The target 10 is water cooled by means of pipes and conduits 13 and 14.

In FIG. 1, the magnetic field H is illustrated as uniform and linear over an extended region. An electron source is shown generally at 15 also located in the region of magnetic field H and arranged to accelerate electrons towards the target in the direction parallel to the lines of flux indicated by the arrows 11. The magnetic field H and the positioning of the target 10 and electron source 15 is such that the source and the target are interlinked by lines of flux of the magnetic field H.

The source 15 comprises a wire filament 16, typically of tungsten, supplied with DC current from a source illustrated by battery 17. The DC current heats the filament 16 to a temperature at which it emits thermionic electrons. A grid or iris 18 is located between the filament 16 and the X-ray target 10 across the lines of flux interlinking the target and filament. The grid or iris 18 is held at earth potential and the filament 16 is held at a relatively high negative potential, typically in excess of 15 kV, by means of a DC EHT supply indicated in FIG. 1 for convenience by the battery pile 19. Thus, an accelerating electric field is established between the grid or iris 18 and the filament 16 so that thermionic electrons from the filament are accelerated by the electric field towards the X-ray target 10.

The operation of an electron gun of this general kind is well known and will not be described further herein. It is sufficient to note however that the electrons for bombarding the X-ray target 10 are accelerated by electric field between the filament 16 and the grid or iris 18. The target 10 itself is held at earth potential.

The magnetic field H is arranged to be sufficiently strong to ensure that electrons accelerated from the filament 16 are constrained to spiral or execute helical paths about the flux lines towards the face 12 of the target 10. Since flux lines interlink the filament 16 and the target 10, the flux of electrons bombarding the target is maximised.

The spacing between the target 10 and the source of electrons 15 is not critical and the two elements of the X-ray source may with advantage be at some distance, as compared with X-ray sources known hitherto. The proximity of the target 10 and electron source 15 as illustrated in FIG. 1 is exaggerated for simplicity and the flight path 20 of accelerated electrons towards the target 10 may be considerably longer. The source of electrons may thus be located in a region of lower magnetic field strength than the anode so that emission may take place over a relatively large area which is projected onto the anode at reduced size. In this way problems of space charge at the source of electrons can be minimised.

In order to ensure that electrons accelerated to energies in excess of 15 kV and having components of these energies at angles to the lines of magnetic flux are fully constrained to spiral about the lines of flux, the magnetic field must be of sufficient strength over the entire flight path of the electrons. Magnetic fields of the order of 7 Tesla have been found satisfactory. It can be shown that the cyclotron orbit of an electron of an energy of 10 kV in a magnetic field of this magnitude has a diameter of only approximately 100 microns. Thus electrons travelling to the target at such energies in such a field are brought to the target with a spacial uncertainty of less than 100 microns.

The magnetic field may be produced by superconducting solenoid magnets. Technology for this purpose is well established and no further details are given herein.

Figure 2:
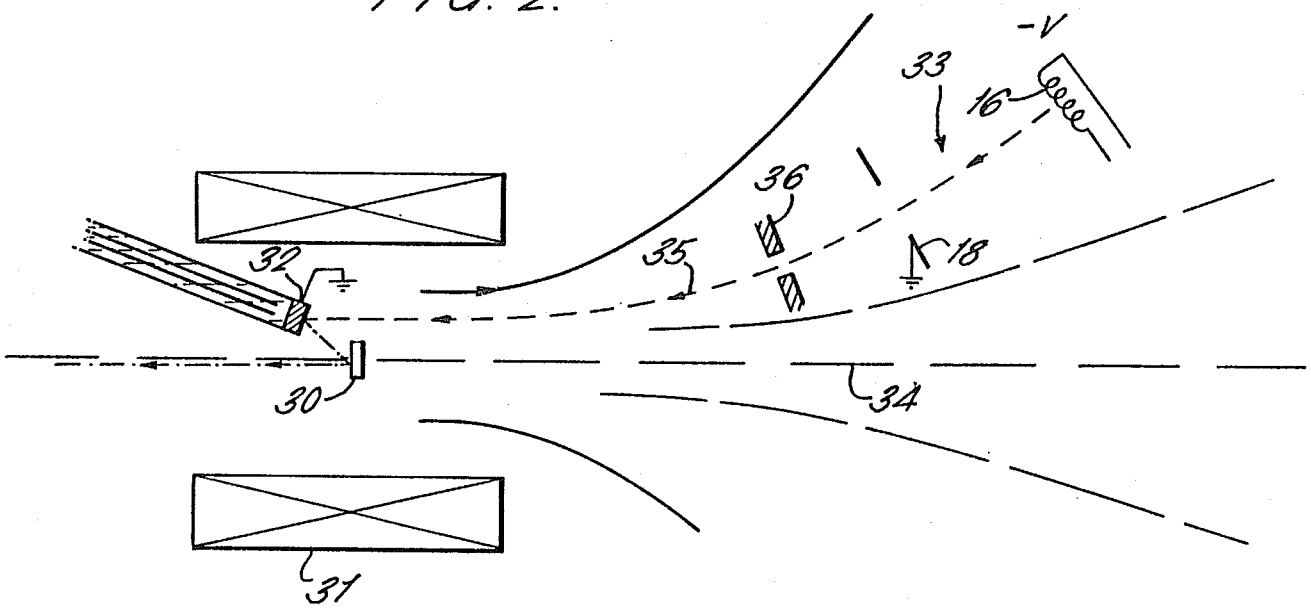
FIG. 2 is a schematic illustration of an X-ray source incorporated as part of a photo-electron spectroscope or microscope.

Referring now to FIG. 2, a variation is illustrated of the arrangement shown in FIG. 1. The X-ray source of FIG. 2 may be used in a photo-electron spectroscope or photo-electron microscope as the electron source for irradiating specimens to emit photo-electrons for analysis purposes. Photo-electron spectroscopes are known and a particular form of photo-electron microscope is described in the specification of International patent application No. PCT/GB 82/00008. The X-ray source illustrated in FIG. 2 could be used in the photo-electron microscope described in the above-mentioned patent application. In that photo-electron microscope, the specimen is located in a region of high magnetic field which constrains photo-electrons emitted by the specimen to spiral around the flux lines of the field and thereby maximising the photo-electron flux for analysis purposes.

Considering FIG. 2, a specimen 30, is located on the axis of an axially symmetrical magnetic field such as produced by a super-conducting solenoid 31. The specimen 30 is arranged to be irradiated with X-rays from an X-ray target 32 such as that illustrated in FIG. 1. The X-ray target 32 is located also in the region of high magnetic field close to the specimen 30 but slightly off the axis of the field. Energetic electrons from an electron gun illustrated generally at 33 are focused onto the target 32 by means of the magnetic field. The super-conducting solenoid 31 is arranged so that the field is weaker in the region of the electron gun 33 with the lines of magnetic flux diverging from the axis as illustrated in the drawing. Thus, the electron gun 33 is located rather further off the axis 34 than the target 32 such that the gun 33 and the target 32 are interlinked by the curved lines of flux of the magnetic field.

In the same way as described above, electrons are accelerated by the gun 33 and constrained to travel along the curving lines of flux so as to bombard the target 32 to produce the desired X-rays which irradiate the specimen 30. The magnetic field strength is sufficient to constrain the electrons at the accelerated energy to follow the curved path 35 illustrated in FIG. 2.

Again, the target 32 can be at earth potential because any elastically scattered electrons from the target are also constrained to spiral back along the lines of flux and therefor cannot contaminate the specimen 30 which is located off the flight path 35 of the electrons.

An aperture 36 is provided along the flight path 35 to block the direct straight line of sight between the filament of the electron gun 33 and the target 32 and specimen 30. Thus, as a result of the curved path 35 of the electrons, neither the target 32 nor the specimen 30 can be contaminated by material evaporated off the filament.

Because the target 32 is at earth potential, there is no need for the usual electrical screens necessary for X-ray sources having positive target anodes. As a result the target 32 can be positioned closer to the specimen 30 to maximise the X-ray flux onto the specimen.

In the arrangement illustrated, the elements of the X-ray source and the specimen 30 of the photo-electron microscope or spectroscope share a common evacuated chamber. However, it may nevertheless be desirable to provide separate pumping for the X-ray source and for the spectroscope or microscope. It will be then necessary to provide a window between the X-ray source and the specimen 30 which is transparent to X-rays. An aluminum foil window may be used. The problem of bombardment of the aluminum window with scattered electrons is obviated so that the danger of excessive heating of the window or the generation of aluminum characteristic parasitic X-rays in the window is avoided.

Figure 3:
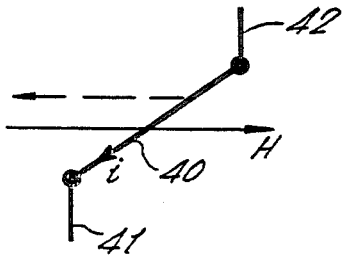
FIGS. 3 and 4 illustrate different arrangements of filament for use in the electron gun of the X-ray source of FIGS. 1 or 2.
Figure 4:
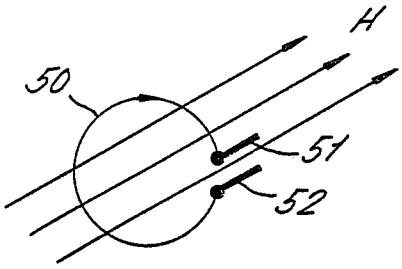

Referring now to FIGS. 3 and 4 two arrangements for the filament 16 of the electron gun or source 15 (FIG. 1) 33 (FIG. 2) are illustrated. Referring to FIG. 3, the filament 40 is arranged to extend in a straight line between support posts 41 and 42. The line of the filament 40 is arranged to be at an acute angle as illustrated to the direction of the magnetic field H. As a result the magnitude of Lorenz forces on the filament wire 40 caused by the DC current i flowing in the wire is reduced, thereby minimising the stress on the filament during operation and undesirable deviation of the filament. It will be understood that the smaller the angle between the line of the filament 40 and the field H the less is the Lorenz force on the wire. However, if the wire 40 is parallel to the field, then the field has the effect of preventing escape of thermionically emitted electrons from the wire. Thus, a compromise angle is employed at which the Lorenz force is satisfactorily reduced without excessive reduction in the electron flux from the filament. Angles between 5° and 30° to the field may be suitable.

An alternative arrangement is illustrated in FIG. 4 in which the filament 50 extends in a circular path between the two supporting pillars 51 and 52 which are arranged side-by-side. The circular filament 50 is orientated in a plane at right angles to the direction of the field H.

In operation, the DC voltage supply to heat the filament 50 is connected between the ends of the circular filament 50 so that the DC current flows about the filament in a direction relative to the direction of the field H which produces a force on the wire of the filament 50 directed radially outwards of the circular filament. In this way, the forces about the wire of the filament 50 do not cause the wire to deviate from the illustrated position, provided the wire of the filament has sufficient strength in tension when heated. Furthermore, forces applied by the ends of the filament 50 to the post 51, 52 are purely tension forces in the wire of the filament so that sheer forces between the ends of the wire and the connecting posts can be eliminated.

We claim:

1. An X-ray source apparatus comprising, in an evacuated chamber, an X-ray target of a selected material which emits X-rays when bombarded with electrons of at least a predetermined energy; a source of electrons; means for accelerating electrons from said source to at least the predetermined energy; means for generating a magnetic field with curved lines of magnetic flux interlinking said target and said electron source and with the magnetic field having sufficient strength over the whole of the interlinking magnetic flux lines between said target and said electron source such that electrons of the energies of those accelerated from said source with components at angles to the magnetic field are constrained by the field to execute helical paths adjacent said source and to travel generally in the direction of the lines of flux, said target being sized and positioned to intercept substantially all of those lines of flux that intercept said electron source so that substantially all the electrons from said source bombard said target to cause said target to emit X-rays; and aperture means blocking straight line paths between said source and said target but permitting passage of substantially all the electrons travelling along the flux lines from said source to said target.

2. Apparatus as claimed in claim 1 wherein said target is at earth potential and the means for accelerating comprises an earthed grid or iris along the lines of flux interlinking said source and said target and means for producing an electron accelerating electrical potential gradient between the source and the grid or iris.

3. Apparatus as claimed in claim 1 further comprising means defining a specimen region; and wherein said target is located adjacent the specimen region in the magnetic field to irradiate a specimen in the specimen region.

4. Apparatus as claimed in claim 3 wherein said specimen region defining means includes means for evacuating said specimen region to a pressure different from the pressure in the evacuated chamber.

5. Apparatus as claimed in claim 1 wherein said means for accelerating comprises an earthed grid or iris along the lines of flux interlinking said source and said target and means for producing an electron accelerating electrical potential gradient between said source and said grid or iris.

6. Apparatus as claimed in claim 1 wherein said electron source comprises a wire filament arranged to extend in a line at an acute angle to the lines of flux at said source, and a DC voltage source to heat said filament.

7. Apparatus as claimed in claim 1 wherein said electron source comprises a wire filament arranged to extend in a circle in a plane perpendicular to the lines of flux at said source, and a DC voltage source connected to heat said filament with a DC current directed about said filament to cause a force on said filament directed radially outwards thereof.

8. Apparatus as claimed in claim 1 wherein said magnetic field generating means generates a magnetic field in the order of about 7 Tesla.

* * * * *